US006733903B1

(12) United States Patent
Suzuki et al.

(10) Patent No.: US 6,733,903 B1
(45) Date of Patent: May 11, 2004

(54) INSERT OF POUR-AROUND DIE CASTING, RUST PREVENTIVE OIL FOR INSERT OF POUR-AROUND DIE CASTING, AND METHOD FOR POURING AROUND AN INSERT

(75) Inventors: Takahiro Suzuki, Yamagata (JP); Akinari Nobumoto, Nagoya (JP); Giichiro Saito, Yamagata (JP)

(73) Assignees: Teipi Industry Co., Ltd., Yamagata (JP); Teikoku Piston Ring Co., Ltd., Tokyo (JP)

( * ) Notice: Subject to any disclaimer, the term of this patent is extended or adjusted under 35 U.S.C. 154(b) by 0 days.

(21) Appl. No.: 09/296,398

(22) Filed: Apr. 23, 1999

(30) Foreign Application Priority Data

Apr. 28, 1998 (JP) ..... 10-119136

(51) Int. Cl.[7] ..... B21D 39/00; F02F 1/00; B22D 19/00

(52) U.S. Cl. ..... 428/624; 428/629; 428/653; 164/100; 164/101; 123/193.2; 123/41.84; 123/668

(58) Field of Search ..... 164/100, 101, 164/98; 428/624, 629, 653; 123/193.2, 41.84, 668

(56) References Cited

U.S. PATENT DOCUMENTS 4,021,256 A * 5/1977 Oda ..... 106/627
4,221,639 A * 9/1980 Ninagawa et al. ..... 428/624
4,479,882 A * 10/1984 Zoleski et al. ..... 508/398

FOREIGN PATENT DOCUMENTS

| | | |
|---|---|---|
| JP | 58071998 | 4/1983 |
| JP | 63018086 | 1/1988 |
| JP | 07118686 | 5/1995 |
| JP | 09241801 | 9/1997 |

* cited by examiner

*Primary Examiner*—Tom Dunn
*Assistant Examiner*—I.-H. Lin
(74) *Attorney, Agent, or Firm*—Smith, Gambrell & Russell, LLP

(57) ABSTRACT

Disclosed are an insert of pour-around die casting, which is incorporated by an aluminum alloy die casting and has an organic film formed on the surface of the insert, wherein the organic film contains a higher fatty acid ester, a petroleum sulfonate and a mineral oil and has a thickness of from 0.5 to 2 $\mu$m, a rust preventive oil used therefor, and a method for incorporating the insert with an aluminum alloy die casting.

5 Claims, No Drawings

INSERT OF POUR-AROUND DIE CASTING, RUST PREVENTIVE OIL FOR INSERT OF POUR-AROUND DIE CASTING, AND METHOD FOR POURING AROUND AN INSERT

SPECIFICATION

Insert of pour-around die casting, rust preventive oil for insert of pour-around die casting, and method for pouring around an insert

BACKGROUND OF THE INVENTION

The present invention relates to a technique for incorporating an insert of pour-around die casting (hereinafter sometimes referred to simply as "insert") with an aluminum alloy, more specifically an insert of pour-around die casting of an aluminum alloy, a rust preventive oil for preventing the insert from rusting, and a method for incorporating the insert with an aluminum alloy die casting.

It has been recently increased to produce cylinder blocks for internal combustion engines having a cylinder liner of a cast iron excellent in abrasion resistance incorporated with a light-weight aluminum alloy die casting. For such a type of incorporated die castings, it is essential that the insert of pour-around die casting is firmly incorporated with the aluminum alloy, and it is not permissible that with the use of the insert, the die casting productivity is inhibited and the rate of casting defects is increased.

Since the production of the insert of pour-around die casting and the production of the aluminum alloy die casting are separately conducted, it is usual that the insert is produced at first and then subjected to die casting after a substantial interval of time. If the surface of the insert is rusted, not only the adhesion with the aluminum alloy deteriorates but also the appearance of the die casting is poor. Accordingly, it is desirable to prevent the insert from rusting during at least the above interval.

The incorporation of the insert of pour-around die casting (by pouring a molten metal around an insert in a mold) has been made by the following methods.

(1) an insert is subjected to indirect rust-preventive treatment by use of an evaporative rust preventive agent, an evaporative rust preventive paper, an evaporative rust preventive film or the like, (2) a rust preventive oil coated on the insert is removed just before the die casting, and (3) die casting is made without removing the rust preventive oil.

However, the above method (1) brings about problems such as a reduction of productivity and an increase of packaging cost, and besides, adequate preventive effects can not be obtained. Further, the above method (2) brings about problems such as necessity of equipments for removal of the rust preventive oil and spaces thereof, and besides, reduction of workability and productivity. Further, the above method (3) brings about problems that, since large amounts of gas and burning residue are produced when the rust preventive oil is contacted with the molten aluminum alloy, formation of casting defects and reduction of adhesion are caused.

Further, adequate studies have not been made on the influences of the rust preventive oil composition and the film thickness on the gas and the burning residue generated when the rust preventive oil is contacted with the aluminum alloy melt, and also the influences of the gas and the burning residue on the die casting properties. For such reasons, it has not generally been practiced to employ a method for incorporating an insert of pour-around die casting coated with a rust preventive oil, directly with an aluminum alloy die casting.

However, in recent years, since the production of incorporated cylinder blocks for mass-produced automobiles has been increased, it is strongly demanded to produce the incorporated die castings of a high quality at a high productivity.

SUMMARY OF THE INVENTION

Accordingly, it is an object of the present invention to sufficiently prevent an insert of pour-around die casting from rusting during the period from its production to die casting, and to provide the insert by which an incorporated die casting of a high quality can be produced even if the insert is directly subjected to die casting, and a rust preventive oil for the insert used therefor, and a method for incorporating it.

In order to accomplish the above object, the present invention provides an insert of pour-around die casting, which is incorporated with an aluminum alloy die casting and has an organic film formed on a surface of the insert, wherein the organic film comprises a higher fatty acid ester, a petroleum sulfonate and a mineral oil and has a thickness of from 0.5 to 2 $\mu$m.

The present invention also provides a solvent-dilution type rust preventive oil of pour-around die casting, which comprises a higher fatty acid ester, a petroleum sulfonate, a mineral oil and a solvent and has a viscosity of from 1 to 5 cSt at 40° C.

The present invention further provides a method for incorporating an insert of pour-around die casting with an aluminum alloy die casting, which comprises coating a rust preventive oil which contains a higher fatty acid ester, a petroleum sulfonate, a mineral oil and a solvent and has a viscosity of from 1 to 5 cSt at 40° C. to form an organic film having a thickness of from 0.5 to 2 $\mu$m on a surface of the insert; placing the insert in a mold; and pouring an aluminum alloy around the insert for die casting.

In the present invention, the higher fatty acid ester in the organic film imparts a rust preventive performance and a low residue property, the petroleum sulfonate improves the rust preventive performance of the higher fatty acid ester, and the mineral oil functions as a rust preventive auxiliary. Further, by adjusting the thickness of the organic film to from 0.5 to 2 $\mu$m, the desired rust preventive performance can be securely obtained, and at the same time, the gas amount generated at the time of die casting and the burning residue amount tend to be low. Accordingly, even if direct die casting is carried out without removing the organic film, casting defects of the incorporated die casting such as voids and pinholes will not be increased, and the insert and the aluminum alloy thus incorporated or integrated can be firmly bonded, whereby the incorporated die casting of a high quality can be produced with a high productivity.

Further, by adjusting the viscosity of the rust preventive oil of the present invention at 40° C. to from 1 to 5 cSt, it is possible to control the thickness as coated to from 0.5 to 2 $\mu$m.

MODE FOR CARRYING OUT THE INVENTION

Hereinafter, the present invention will be described in further detail with reference to preferred embodiments.

The rust preventive oil of the present invention is a solvent-dilution type rust preventive oil, which contains a higher fatty acid ester, a petroleum sulfonate, a mineral oil and a solvent and has a viscosity adjusted to be from 1 to 5 cSt at 40° C.

In this case, it is preferred that the higher fatty acid ester has a weight-average molecular weight of from 300 to 600. If the weight-average molecular weight is less than 300, the gas amount generated when this oil is contacted with the aluminum alloy melt tends to be large, and if it exceeds 600, the burning residue amount tends to be large.

Further, the rust preventive oil of the present invention may preferably contain a higher fatty acid salt having a weight-average molecular weight of from 300 to 600 in addition to the above components, by which it is possible to impart water resistance to the formed organic film.

If the viscosity is less than 1 cSt, it is difficult to adjust the thickness of the formed organic film to not less than 0.5 $\mu$m, and if it exceeds 5 cSt, the formed organic film tends to exceed 2 $\mu$m.

As the composition of the rust preventive oil of the present invention, the higher fatty acid ester is preferably contained in an amount of from 3 to 8 vol %, more preferably from 3 to 6 vol %, most preferably from 3 to 5 vol %, the petroleum sulfonate is contained in an amount of from 2 to 5 vol %, more preferably from 2 to 4 volt % most preferably from 2 to 3 vol %, and the mineral oil is contained in an amount of from 5 to 15 vol %, more preferably from 5 to 10 vol %, most preferably from 5 to 8 vol %.

Incidentally, it can be said that the rust preventive oil of the present invention is similar to solvent-dilution type rust preventive oils NP-2 and NP-3 as prescribed in JIS K2246 in the composition. However, the solvent-dilution type rust preventive oils NP-2 and NP-3 include many types of rust preventive oils of which the properties varies in a wide range. For example, the viscosity ranges from 1.2 to 50 cSt, and the film thickness ranges from 0.5 to 50 $\mu$m. Further, as a rust preventive agent, some types may contain a petrolactum oxide salt, wax, a paraffin oxide-salt, a paraffin oxide, etc. without containing the higher fatty acid ester as the essential component of the present invention.

The insert of pour-around die casting of the present invention is applicable to various uses, and particularly suitable to a cylinder liner made of cast iron. By pouring the outside of the cylinder liner with an aluminum alloy die casting, a cylinder block for an internal combustion engine can be obtained.

In the method for incorporating the insert of the present invention, as a method for coating the rust preventive oil on the surface of the insert such as a cylinder liner, a shower method, a dipping method and other methods may be employed. By drying the solvent by volatilization after coating, an organic film having a thickness of from 0.5 to 2 $\mu$m is formed on the surface of the insert. In this case, if the thickness of the organic film is less than 0.5 $\mu$m, the rust preventive performance tends to be inadequate, and if it exceeds 2 $\mu$m, die casting properties tend to be low.

Since the insert of the present invention having the organic film formed on its surface, is free from the formation of rust by virtue of the organic film, it is suitable to cylinder liners for exportation which are left for a long period of time from its production to the die casting process.

The insert of the present invention may be placed in a mold without removing the organic film on its surface, and directly subjected to die casting with an aluminum alloy. At that time, the organic film is decomposed by the contact with the aluminum alloy melt and thereby scattered, and the burning residue amount and the generated gas amount are extremely little, whereby the formation of casting defects of the incorporated die casting such as voids and pinholes, is not increased, and the insert and the aluminum alloy can firmly be bonded. Accordingly, an incorporated die casting of a high quality can be produced with a high productivity.

Incidentally, after a burning test of the organic film at 600° C. for 1 minute, the residue amount is preferably from 0.1 to 0.3 g/m$^2$, more preferably from 0.1 to 0.25 g/m$^2$, and the generated gas amount is preferably from 2.0 to 5 liters/m$^2$, more preferably from 2 to 4 liters/m$^2$. If the residue amount and the generated gas amount are less than the above ranges, it is required to adjust the film thickness to less than 0.5 $\mu$m, whereby the rust preventive performance tends to be low. If the residue amount and the generated gas amount exceed the above ranges, the formation of casting defects and the reduction of the adhesion of the insert are caused.

EXAMPLES

Firstly, rust preventive performances, generated gas amounts and residue amounts were evaluated when various types of rust preventive oils were used for a cylinder liner. The composition of the rust preventive oil used in Example 1 is indicated in Table 1 and the main physical properties of this rust preventive oil are indicated in Table 2.

TABLE 1

| | |
|---|---|
| Higher fatty acid ester | 5.5 vol % |
| Higher fatty acid salt | 0.5 vol % |
| Petroleum sulfonate | 3.0 vol % |
| Mineral oil | 7 vol % |
| Solvent | 84.5 vol % |

TABLE 2

| | |
|---|---|
| Viscosity (cSt) at 40° C. | 2.0 |
| Specific gravity (15/4° C.) | 0.81 |
| Flash point (° C.) | 72 |
| Flow-point (° C.) | at most −15° C. |

Main components, properties and rust preventive performance in wetting test, of rust preventive oils used in the test for evaluating rust preventive perfoxitakice, are indicated in Table 3. These rust preventive oils were coated by a shower method. However, these may be coated by a dipping method or other methods. After the coating, the cylinder liners were dried at room temperature. The drying was conducted for ¼ to 1 hour.

In Table 3, the film thickness after drying was determined by calculation from the measured surface area and weight of the cylinder liner, and the specific gravity of the residual component. Further, the wetting test was conducted as follows. The cylinder liner was placed in a test vessel, and maintained in an atmosphere at 20° C. and a humidity of 60% and in an atmosphere at 40° C. and a humidity of 90%, for 1 hour, respectively. This operation was taken as one cycle. This cycle was repeated 168 times, and then the formation of rust was evaluated.

Further, the generated gas amount and the residue amount by the burning test were determined as follows. The cylinder liner was heated at 600° C. for 1 minute in a heating oven. The weight before the heating and the weight after the heating were measured to determine a vaporized amount. The generated gas amount and the residue amount were calculated from the chemical composition and the number of moles of the oil composition, assuming that the vaporized, amount was generated by the decomposition of the oil into $H_2O$ and $CO_2$ by complete combustion.

TABLE 3

| | Main components of rust preventive oil | Viscosity (cSt) | Film thickness (μm) | Rust preventive performance: Unfinished cast iron liner | Rust preventive performance: Machine-finished liner | Burning test: Generated gas amount ($L/m^2$) | Burning test: Residue ($g/m^2$) |
|---|---|---|---|---|---|---|---|
| Ex. 1 | *1 | 2.0 | 1 | ○ | ○ | 4 | 0.2 |
| Comp. Ex. 1 | " | 6 | 2.5 | ○ | ○ | 6 | 0.4 |
| Comp. Ex. 2 | " | 0.9 | 0.4 | ○ | Δx | 3 | 0.1 |
| Comp. Ex. 3 | *2 | 1.2 | 0.5 | ○ | Δ | 5 | 0.3 |
| Comp. Ex. 4 | " | 1.3 | 1 | ○ | Δ | 5 | 0.3 |
| Comp. Ex. 5 | " | 3.1 | 3 | ○ | ○ | 8 | 1.0 |
| Comp. Ex. 6 | " | 8.2 | 6.0 | ○ | ○ | — | — |

Note:
*1 a higher fatty acid ester having a weight-average molecular weight of from 300 to 600, a higher fatty acid salt, a petroleum sulfonate, a mineral oil and a solvent.
*2 a petrolactum oxide salt, a petroleum sulfonate, a mineral oil and a solvent.
In the column of rust preventive performance, the mark "○" indicates no rust formed, the mark "Δ" indicates slight rust formed, and the mark "x" indicates serious rust formed.

From the results of Table 3, it is found that the rust preventive oil used in Example 1 provides a thin film of a low viscosity, generates a low gas amount and a low residual amount in the burning test, and imparts adequate rust preventive performance to each of the unfinished cast iron surface of the cylinder liner and the machine-finished surface of the cylinder liner.

Then, in order to prove the effects of the present invention, a die casting test of a cylinder block was carried out. The cylinder block produced in this test was of a straight-type four cylinder-type made of ADC12 (prescribed in JIS-H 5302, which is similar to ASTM B85-84 383.0), and of an open-deck type. The cylinder liner was made of cast iron. The inner diameter of the cylinder liner was 80 mm, and the thickness was 3 mm. The die casting machine was of a cold-chamber type. Further, the die casting temperature of the aluminum alloy was about 600° C. In this test, no preliminary heating was carried out, although the cylinder liner may be preliminarily heated at a temperature of from 100 to 250° C. before it is placed in a die casting mold.

In the die casting test, a cylinder liner using no rust preventive oil as a standard, the one coated with the rust preventive oil of Example 1, the one coated with the rust preventive oil of Comparative Example 1, the one coated with the rust preventive oil of Comparative Example 3, and a cylinder liner of which the surface is rusted, were used. After die casting the aluminum alloy, the void and the yield of die casting were evaluated. Here, the void was determined as follows. At the cut surface perpendicular to the cylinder liner axis, the boundary between the liner and the aluminum alloy was inspected by a penetration flaw detection, and the length of defective portion was divided by the length of circumference to determine the void. The results are indicated in Table 4.

TABLE 4

| Items of evaluation | Example 1 | Comparative Example 1 | Comparative Example 3 | Rusted products |
|---|---|---|---|---|
| Void | ○ | ○ | Δ | x |
| Yield | ○ | Δ | x | Δ |

Note:
The mark "○" indicates to be equal to the standard. The mark "Δ" indicates to be a little inferior to the standard. The mark "x" indicates to be inferior to the standard.

From the results of Table 4, it is found that the cylinder liner coated with the rust preventive oil of Example 1 shows a low void and a high yield as compared with the cylinder liners coated with the rust preventive oil of Comparative Example 1 or Comparative Example 3 and the rusted cylinder liner.

Totally taking the results of Tables 3 and 4 into consideration, the cylinder liner coated with the rust preventive oil of Example 1 is excellent in the rust prevention performance and the incorporated die casting property.

As mentioned above, according to the present invention, by forming an organic film which contains a higher fatty acid ester, a petroleum sulfonate and a mineral oil and has a thickness of from 0.5 to 2 μm on the surface of an insert of pour-around die casting, it is possible to secure a rust preventive performance even if the period prior to die casting is long, and besides, when the oil is contacted with the aluminum alloy melt for die casting, the generated gas amount and the burning residue amount will be small. Accordingly, even if die casting is directly carried out without removing the organic film, the formation of casting defects such as voids and pinholes, will not be increased, firm bonding between the insert and the aluminum alloy can be obtained, whereby it becomes possible to produce an incorporated die casting of a high quality with a high productivity.

What is claimed is:

1. An insert for a pour around die casting, for use with an aluminum alloy, said insert having an organic film formed on at least a surface of the insert for contacting the aluminum alloy, wherein the organic film comprises a higher fatty acid ester, a petroleum sulfonate and a mineral oil and has a thickness of from 0.5 to 2 μm.

2. The insert for a pour-around die casting according to claim 1, wherein the organic film forms a residue of from 0.1 to 0.3 $g/m^2$ and a generated gas amount of from 2.0 to 5 $liters/m^2$ after a burning test at 600° C. for 1 minute.

3. The insert for a pour-around die casting according to claim 1, wherein the higher fatty acid ester has a weight-average molecular weight of from 300 to 600.

4. The insert for a pour-around die casting according to claim 1, wherein the organic film further comprises a higher fatty acid salt having a weight-average molecular weight of from 300 to 600.

5. The insert for a pour-around die casting according to claim 1, wherein the aluminum alloy die casting is a cylinder block for an internal combustion engine and the insert for a pour-around die casting is a cylinder liner of cast iron.

* * * * *